United States Patent [19]

Wolford

[11] 4,145,008

[45] Mar. 20, 1979

[54] WASTE MATERIAL PUMPING APPARATUS

[75] Inventor: Dale E. Wolford, Ashland, Ohio

[73] Assignee: The Gorman-Rupp Company, Mansfield, Ohio

[21] Appl. No.: 826,458

[22] Filed: Aug. 22, 1977

[51] Int. Cl.[2] ..... B02C 23/36

[52] U.S. Cl. ..... 241/46.17; 241/185 A

[58] Field of Search ..... 241/46 R, 46.04, 46.06, 241/46.11, 46.17, 84, 86, 86.2, 88.1, 89.4, 185 A

[56] References Cited

U.S. PATENT DOCUMENTS

| | | | |
|---|---|---|---|
| 2,496,359 | 2/1950 | Rymann | 241/46.04 |
| 3,109,471 | 11/1963 | Highley | 241/89.4 |
| 3,323,650 | 6/1967 | Kilbane, Jr. | 241/46.17 |
| 3,367,583 | 2/1968 | Kellogg | 241/46 R |
| 3,429,513 | 2/1969 | Gribble | 241/46 R |
| 3,666,187 | 5/1972 | Norris | 241/46.17 |

*Primary Examiner*—Howard N. Goldberg

*Attorney, Agent, or Firm*—Watts, Hoffmann, Fisher & Heinke, Co.

[57] ABSTRACT

A waste material distribution system including a holding tank, a self-priming centrifugal pump located above the liquid level in the tank having its suction inlet connected to a vertical drop pipe, a cutter plate having flow ports therethrough at the mouth of the drop pipe, rotatable cutter blades below the plate, power means for rotating the blades at speeds independent of the pump impeller in order to disintegrate solids contained in the waste material, and paddle blades below the cutter blades for establishing vortex circulation below the mouth of the drop pipe and converting solid or semi-solid waste material to a pumpable slurry.

10 Claims, 6 Drawing Figures

Fig. 1
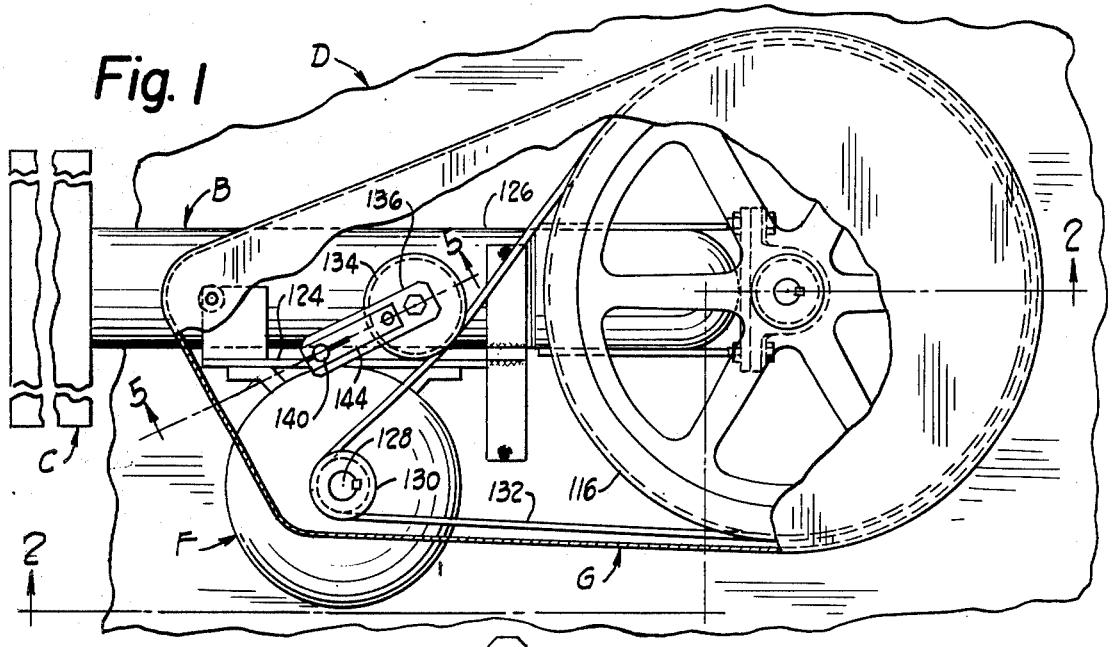
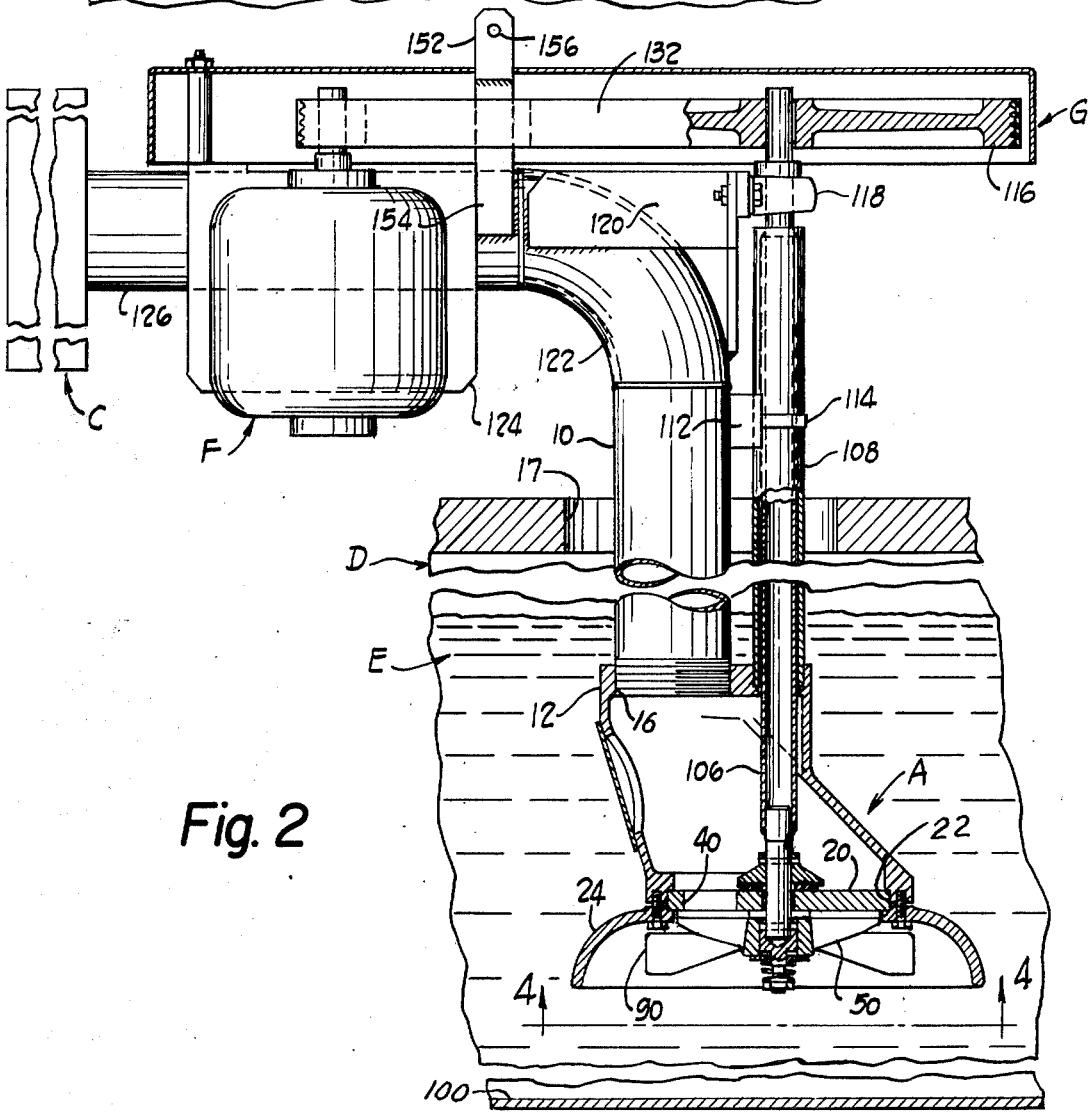
Fig. 2

WASTE MATERIAL PUMPING APPARATUS

BACKGROUND OF THE INVENTION

1. Field of the Invention

The invention relates generally to a waste material handling system, and more specifically to liquid manure systems and the like including apparatus for pumping the waste material from a holding tank.

2. Description of the Prior Art

Many sewage and animal waste treatment systems provide for collecting raw waste products or materials in holding or storage tanks from which the material is periodically pumped for subsequent processing or disposal. During storage heavier solid products settle out at the bottom of the holding tank. Lighter solid products accumulate on the top of the liquid in the tank and evaporation of the liquid in the tank results in a layer or cake of solids building up on the surface of the liquid. Before the waste products can be pumped from the holding tank, the solid and/or semi-solid cakes on the surface and at the bottom of the tank must be macerated and/or comminuted and mixed with the liquid into a slurry-like pumpable material. Any stringy material present in the waste which might clog or otherwise affect the pumping system, for example, rags contained in sewage and hay and/or straw in manure, must be cut, ground and/or chopped to manageable size.

Typically, holding tanks of the character mentioned are emptied by submergible centrifugal pumps. Such pumps may be provided with different types of cutting tools, choppers, or the like, the rotors of which are attached to the pump impeller shaft ahead of the impeller. In practice the pump is usually started and valved to discharge back into the holding tank. Recirculation is continued until the solids are liquefied or reduced to a pumpable material. The pump is then valved to empty the holding tank.

A functional centrifugal pump must operate with high impeller speeds in order to develop usable heads. The conventional pumping apparatus in which the chopping or cutting tools are connected to the impeller shaft is characterized by high power consumption. For example, the tool attachment may use 50% of the available power for the pump. The high speed rotation of the tools has the further disadvantages of increasing the net positive suction head absolute required by the pump, reducing the efficiency of the cutting operation in many applications, and causing rapid wear and dulling of the cutting edges. Since the pump operation is dependent upon the condition of the cutting or shearing edges, it can quickly plug or lock-up when the tools become dull.

SUMMARY OF THE INVENTION

The present invention provides a novel and improved solid or semi-solid material disintegrator and vortex circulation device to be located near the bottom of a holding tank of a waste disposal system, such as, a sewage disposal system or a liquid manure system, ahead of the suction inlet of a pump employed to empty the holding tank, and having a bell-like flange at the pump intake extending downwards from a shear plate and a rotatable knife or chopper at the lower side of the shear plate for cutting or chopping material. The rotatable member at the lower side of the shear plate, in addition to knife or chopper blades, includes paddles for creating vortex circulation of material in the holding tank below the suction inlet.

The knife or chopper blades are preferably driven at a speed less than that of the impeller of the pump, by a variable speed motor or adjustable speed device, to reduce the overall power requirements of the installation, and wear of the disintegrating tools. The use of a variable speed drive increases the efficiency of the disintegrating tools by making it possible to select the optimum speed for the rotating knife for the type of material being pumped. The knife or chopper is spring loaded against the shear plate and during operation continuously wipes the shear plate free of material that might otherwise accumulate thereon. The knife or chopper preferably has one more or one less blades than there are openings in the shear plate so that only one blade is cutting at any particular instance. The shear plate is preferably reversible to increase the periods between which it is necessary to sharpen the cutting edges thereof.

BRIEF DESCRIPTION OF THE DRAWING

FIG. 1 is a plan view, with a part broken away, of an apparatus embodying the present invention;

FIG. 2 is a view, with parts broken away, as seen from approximately the line 2—2 of FIG. 1;

DESCRIPTION OF PREFERRED EMBODIMENT

Figure 3:
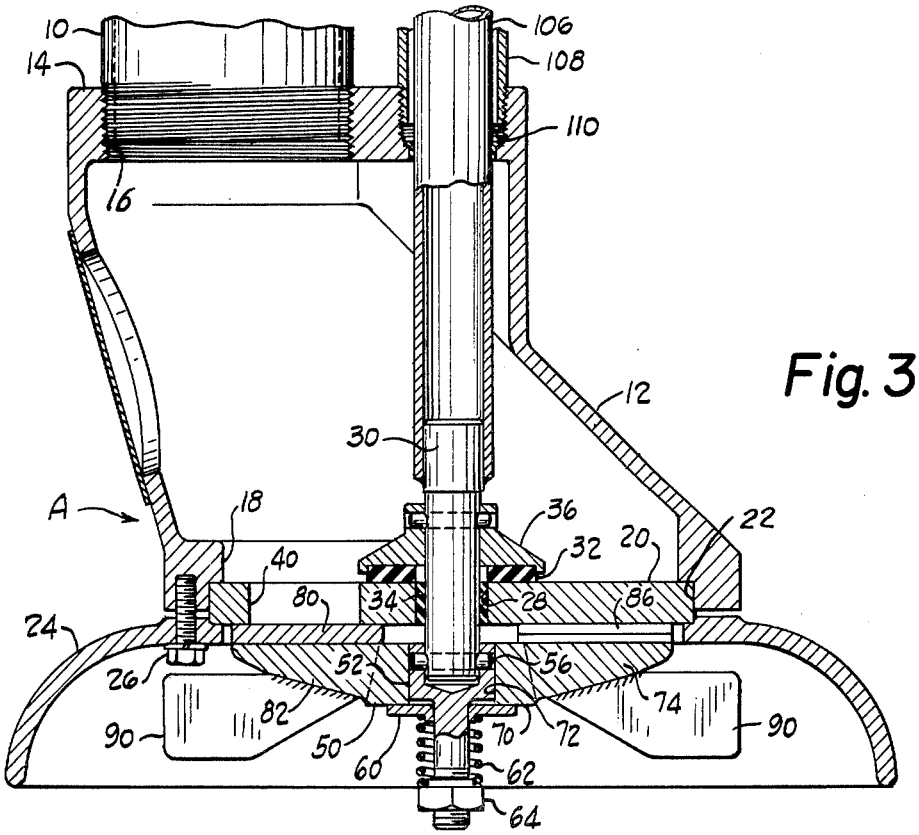
FIG. 3 is an enlarged view of a portion of FIG. 2.
Figure 4:
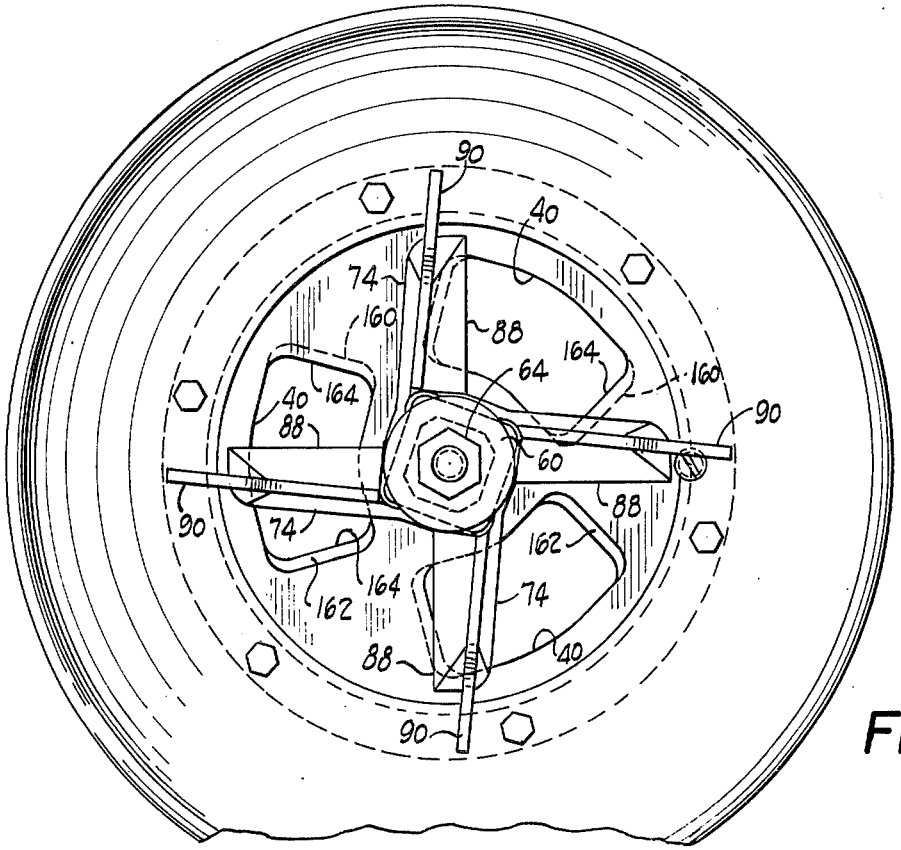
FIG. 4 is a view as seen from the line 4—4 of FIG. 1.

The reference character A designates generally a combination solid material chopper and vortex circulation device connected to the inlet end of a drop section 10 of a suction pipe B the other end of which is connected to a centrifugal-type self-priming pump C. The device A includes a tubular-like housing or suction adapter 12 having an upper end 14 provided with a threaded aperture 16 for connection to the lower end of the drop section 10 extending vertically through an opening 17 in the top of the tank D. The open end 18 of the suction adapter 12 is circular and has a disk-like hardened steel shear plate 20 located in a counterbore 22 in its open lower end and within which counterbore the shear plate 20 is clamped by a bell-like inlet member 24 by cap screws 26.

The circular shear plate 20 is provided with a central through aperture 28 within which a short shaft 30 is rotatably supported by a disk-type thrust bearing 32 and a sleeve bushing 34. The bearings 32,34 are preferably made of carbon or a plastic suitable for the material to be pumped. The lower side of a collar member 36 pinned to the shaft 30 above the shear plate 20 engages the thrust bearing 32. Radially outwardly of the bearing 32 the shear plate 20 is provided with a plurality of through arcuate openings 40. At the side of the shear plate 20 opposite to the collar member 36 a member 50 is keyed, for movement axially of the shaft 30, to a cylindrical member 52 having an aperture in one end into which the shaft 30 projects and to which the member 52 is fixed by a pin 56. The other end of the member 52 is of reduced diameter and supports a washer-like member 60 which engages the member 50. The member 60 is biased towards the member 50 and in turn the member 50 towards the shear plate 20 by a compression spring 62 interposed between the member 60 and a nut 64 threaded onto the end of the reduced part of the member 52.

The member 50 has a hub part 70 provided with a through aperture 72 within which the member 52 is slidably received and a plurality of radially extending blade parts 74 each having a cutting edge on a hard alloy steel member 80 welded to the sides of the blades 74 adjacent to the shear plate 20. The hub 70 and the blades 74 are sometimes herein referred to as the knife member or part 82 and constitute the rotatable member of the cutting or chopping tools shown. The stationary tool member is the plate 20. The members 80 are of a length to span radially the apertures 40 in the shear plate 20 and their sides facing the shear plate are beveled rearwardly as indicated by the reference character 86 from a cutting edge 88 referring to the direction in which the member 50 rotates during operation of the pump etc. The depicted member 50 has four blade parts 74 extending radially from the hub part 70 and equally spaced thereabout. Each blade part 74 has an axially extending plate-like impeller paddle member or part 90 extending radially outwardly from the blade into the aperture of the bell inlet member 24 a distance equal to about two-thirds of the diameter of the open end of the member 24.

In the illustrated apparatus the combination chopper and vortex circulation device A is suspended by the drop section 10 of the suction pipe B of the pump C in a holding tank D below the level of the liquid E therein and adjacent to the bottom 100 of the tank, typically about 6" and 8" from the bottom of the tank. The pump C is preferably of the self-priming centrifucal type and may be any one of a number of suitable commercially available pumps including the pump or pumps described in U.S. Meister et al. U.S. Pat. No. 3,898,014. The shaft 30 is rotated by an electric motor F located above the tank D as is the pump C to which the pipe B is connected. The upper end of the shaft 30 is connected to a tubular shaft 106 extending upwardly through a galvanized pipe 108. The lower end of the pipe 108 is threaded into a tapped counterbore 110 in the end 14 of the suction adapter 12 and is connected adjacent to its upper end to the suction pipe B by an angle member 112 welded to the pipe B and a band-type clamp 114. The shaft 106 extends upwardly through the pipe 108 and has a V-belt pulley 116 fixed thereto. A conventional pulley block bearing 118 bolted to a bracket 120 welded to the elbow 122 of the pipe B supports the shaft 106 between the end of the pipe 108 and the pulley 116.

The shaft 30 may extend outwardly of the suction adapter 12, if desirable. In such event it is preferably supported where it would extend through the wall of the suction adapter 12 by a bearing similar to the bearing 34 which bearing could be located immediately adjacent the end of the pipe 108 connected to the adapter.

The pulley 116 is driven by the electric motor F, preferably of the variable speed type, connected to a bracket 124 welded to a section 126 of the suction pipe B extending from the elbow 122 to the pump C. The drive shaft 128 of the motor F is parallel with the axis of the shaft 106 and carries a V-belt pulley 130 keyed thereto which is operatively connected to the pulley 116 by a multiple "V" belt drive 132 the desired tension of which is maintained by an adjustable idler pulley 134.

The idler pulley 134 is located between two plates of a lever member 136 and rotatably supported on the shank of a bolt 138 in the free end of a lever member 136. The other end of the lever member 136 is rotatably connected to a short shaft 140 welded to the bracket 124 which carries the motor F. The lever arm 136 is held in an adjustable predetermined angular position relative to the shaft 140 by a spring loaded detent 142 in the end of a lever arm 144 adjustably connected to the shaft 140 above the lever arm 136. The detent 142 is biased outwardly of the lower side of a lever arm 144 and engages in a recess in a member fixed in the upper side of the lever arm 136. The lever arm 144 is adjusted to maintain desired belt tension on the tight side of the belt 132 for normal driving torque. In the event an obstruction should overload or lock the rotating member 50 causing an increase in driving torque in excess of that for which the detent 142 is set the increase in belt tension will cause the lever arm 136 to be released from the detent 142 loosening the belt 132 and allowing the drive to the rotating member 50 to slip without affecting the operation of the pump C. The drive described including the driving pulley 130, the belt 132, the driven pulley 116 and the take up roller 134 etc. is provided with a sheet metal cover G.

The intake member 24 is shaped like a shallow bell, or possibly more like an inverted soup dish, with the member 50 located in the concave side. In the exemplary apparatus the size of the suction pipe B is about four and one half inch (4½") or about eleven and forty three hundredths centimeters (11.43 cm), the diameter of the open end of the intake member 24 is about sixteen inches (16") or about forty and sixty four hundredths centimeters (40.64 cm.) and the depth of the bowl of the member 24 is about two and one-half inches (2½") or about six and thirty five hundredths centimeters (6.35 cm.). The diameter of the member 24 at its base is about ten inches (10") or about twenty five and four-tenths centimeters (25.4 cm.) as is the maximum diameter of the member 50 which is at the paddle parts. The diameter of the member 50 at the blade parts 74 is about eight inches (8") or about twenty and thirty two centimeters (20.32 cm.). The blade parts 74 of the member 50 are about one and one half inches (1.5") or three and eighty-one hundred centimeters (3.81 cm.) wide at their hub ends decreasing to about one inch (1") or about two and fifty four hundredths centimeters (2.54 cm.) at their tips. The parts 80 of the blades 74 are about two and seventy five hundredths inches (2.75") or about seven centimeters (7 cm.) long, six hundred and twenty five thousandths inches (0.625") or about one and fifty nine hundredths centimeters (1.59 cm.) wide. The major parts of the paddles are radially outwardly of the knife blades leaving the center of the member 50 relatively free for the ingress of material to the pump.

The construction is such that as the member 50 rotates the paddle parts 90 assisted by the suction of the pump creates a vortex, that is, a whirling mass of liquids and solids in advance of the material cutting or chopping tools and between the entrance of the apparatus and the floor of the holding tank. Solids which are too large to pass through the apertures 40 in the shear plate 20 are rejected and recirculated and disintegrated by the paddle parts 90 of the member 50 until they are reduced to pumpable size. The paddle parts 90 of the knife create considerable disturbance in the material at the bottom of the tank agitating the heavier solids at the bottom of the tank and thus assists in their removal. The location of the rotor 50 at the intake side of the shear plate 20 prevents the bridging of large lumps or chunks of material over the openings in the shear plate as the plate is continuously wiped clean by the knives.

The knife member or assembly of the depicted apparatus has four (4) blades 74 and the cutting edges 88 of the members 80 are linear, extend radially or substantially radially of the axis of rotation of the knife. In the depicted apparatus the cutting edges 88 are offset forwardly of the axis of rotation of the member 50 about twenty five hundredths of an inch (0.25") or about six point three millimeters (6.3 mm.) and face in the direction in which the knife rotates during operation of the apparatus. The slots or apertures 40 in the shear plate 20 of which there are three (3) in the depicted apparatus are arcuate, are of equal width being about two inches (2") or about five centimeters (5 cm.) wide and each extends through an area of about 110°. The ends 160,162, respectively, of the apertures 40 are linear and if extended would be spaced outwardly about one and five tenth inches (1.5") or about three and eighty-one hundredths centimeters (3.81 cm.) on opposite sides of the axis of rotation of the knife assembly 82 or at an angle of about 15°. This angle, however, is not critical but is intended to serve a self sharpening function as wear occurs on the engaging surfaces of the knife and shear plate. The angle may be as great as about 45°. Opposite end 160,162 of the apertures 40 are beveled in opposite directions to provide cutting edge 164 for cooperation with the cutting edges 88 of the knife 82. The oppositely oriented bevels at opposite ends of the apertures 40 make the shear plate 20 reversible thus increasing its life between sharpenings.

The construction is such that as the knife member 82 rotates, stringy parts of the material being pumped are cut in what may be characterized as a scissors action by cooperating knife edges 88 and 164 on the knife blades 74 and the shear plate 20, respectively. As the knife member 82 rotates the cutting edges 88 thereof close the ends of the slots under which they are passing beginning at the radially outer corner of the end of the slot being approached and progressively move inwardly over the cutting edges 164 of the linear sides of the slots with an action analogous to that of a scissors but in reverse. The angle made by the cutting edges 88 and 164 of the depicted apparatus increases during a shearing or cutting action varying from about 10° to about 35°. This reduces the effective radius length from the center of the knife to the cutting point and in turn the torque and power required to cut or chop a given amount of material. The cutting edges on both the knife member 82 and the shear plate 20 of the preferred embodiment are linear but they could be accurate. In either construction, however, the shear angle preferably increases as the cutting action progresses with the termination thereof occurring on a short radius.

The knife member 82 in the depicted apparatus has four blades and the shear plate three apertures 40. Where the number of blades of the knife member is one more or less than the number of apertures in the shear plate and the blades and apertures are both arranged symmetrically about the axis of relative rotation therebetween only one cutting or chopping operation is taking place at one time thus minimizing the power requirements.

Stringy and like material in the waste being handled should be cut to lengths not greater than the inside diameter of the suction pipe to the pump to prevent bridging and/or plugging the material in the suction piping and/or the pump. In the preferred embodiment shown the rotor 50 is preferably driven at speeds from about two hundred (200) to five hundred (500) revolutions per minute considerably less than the speed of the impeller of the pump C which is normally from about eleven hundred (1100) to about seventeen hundred (1700) revolutions per minute. Driving the rotor 50 at less than pump impeller speeds reduces the wear of the disintegrating tools, thus increasing their lives, does not interfere with the operation of the pump and also reduces the overall power requirements that would otherwise be necessary to operate the apparatus. In the apparatus shown the net area of the apertures 40 in the shear plate 20 is about two (2) times the cross section area of the suction pipe B. This has been found to produce optimum velocity of material flow through the shear plate using a pump C driven by a twenty five (25) horsepower motor. The motor F in the depicted apparatus is a three (3) horsepower motor.

In the depicted apparatus the pump C is located outside of the holding tank and the combination solid material chopper and vortex circulation or creating device is connected to the submerged end of the pump suction pipe. This arrangement avoids the disadvantage inherent in submerged pumps but it is to be understood that the combination of chopper and vortex creating device of the present invention could be directly connected to the inlet of a submerged pump and that the vortex creating feature of the invention can be used with various material disintegrating tools. In any event the rotating member or members of the disintegrating tools are preferably driven at speeds considerably less than the speed of the pump.

The pumping apparatus depicted in FIGS. 1 to 5 and described above is supported from without the tank D. In permanent installations this is the preferred arrangement. If the pumping apparatus is to be frequently removed from the tank, as would be the situation in a waste disposal system utilizing a plurality of tanks and wherein a single pumping apparatus is moved from tank to tank, it may be preferably to support the pumping apparatus from the bottom of the tank as illustrated in FIG. 6.

Figure 5:
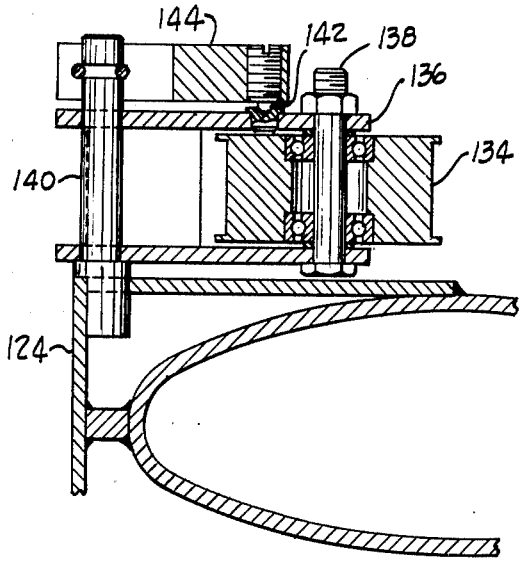
Figure 6:
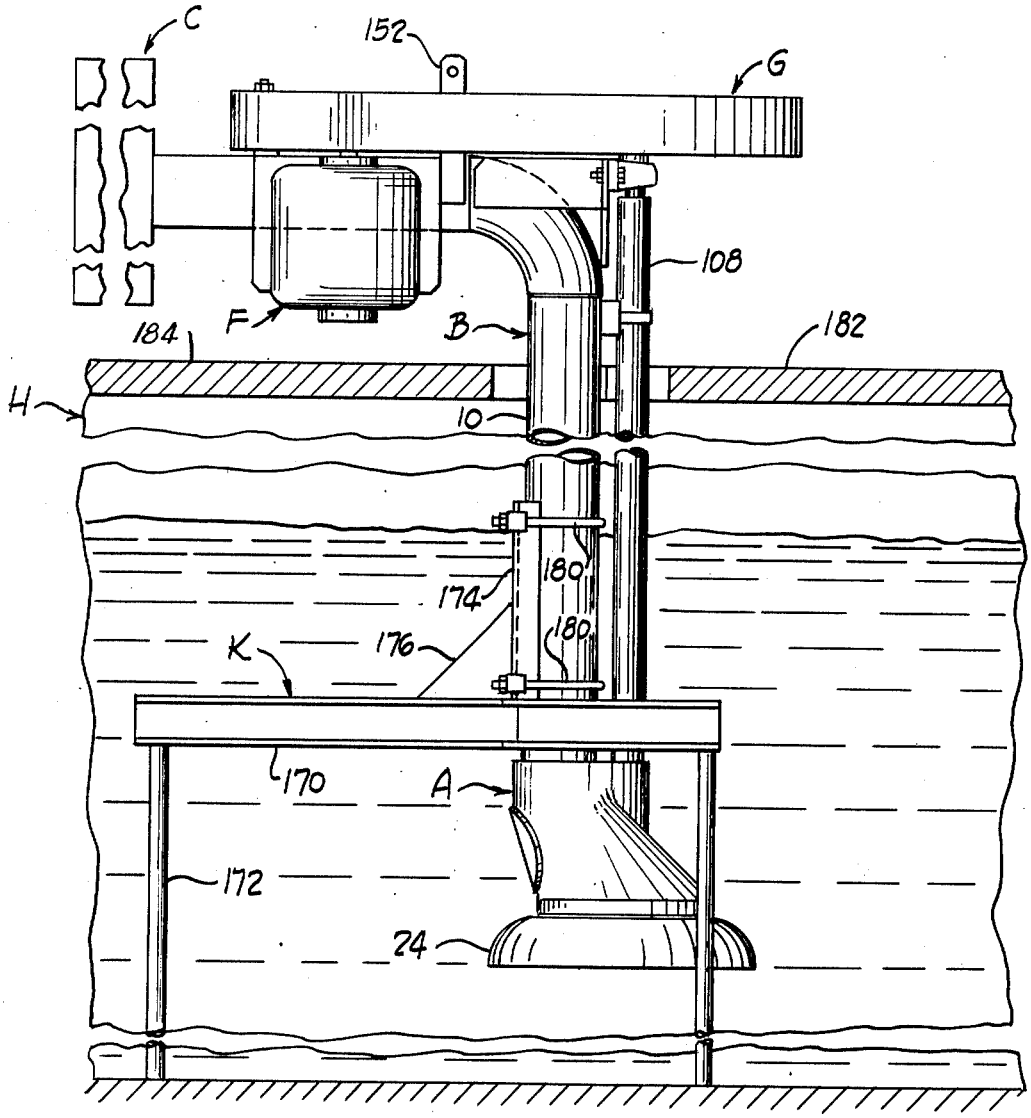
FIG. 6 is an elevational view showing an alternative or auxilliary support for the apparatus.

The pumping apparatus shown in FIG. 6 is a duplicate of that shown in FIGS. 1 through 5 and the various parts are designated by the same reference characters. The pumping apparatus of FIG. 6, however, is supported from the bottom of the tank H by a stand designated generally by the reference character K. The stand K comprises three duplicate horizontal structural members which in the depicted apparatus are channels 170 welded together into a Y configuration and supported from the bottom of the tank H by rod-like legs 172 connected to the free ends of the channels. Only two of the members 170,172 appear in the drawings. In addition to the parts mentioned above the stand includes a vertical channel member 174 welded to the members 170 where they are joined to one another and extending upwardly therefrom. The member 170 is braced by a guesset 176 welded thereto and to one of the members 170.

The channel of the member 174 faces in the direction opposite to the length of one of the members 170 and the drop section 10 of the suction pipe B of the pumping apparatus is received therein and connected thereto by U-bolts 180. The legs 172 of the stand K are of a length that when the pumping mechanism is connected to the stand K the intake is at the desired distance from the bottom of the tank. Because the legs 172 of the stand K are relatively small and the members 170 are relatively long the stand K provides a suitable support for the relatively heavy pumping mechanism in spite of the accumulation of waste solid or semi-solid material in the bottom of the tank. In the apparatus shown in FIG. 6 the tank H is provided with a cover comprising two movable members 182,184 abutted against one another so that the top of the tank can be opened for ready removal of the pumping apparatus from the tank by the connection of a hoist mechanism to the member 152 at the top of the pumping apparatus.

From the foregoing description of the preferred embodiment of the invention it will be apparent that there has been provided a novel and improved waste material handling system including a solid material chopper and vortex circulation device at the inlet of a centrifugal pump suitable for handling waste material and that the heretofore enumerated objects and others have been accomplished. While the preferred embodiment of the invention has been described in considerable detail it is to be understood that the invention is not limited to the constructions disclosed. Instead of driving the rotatable member of the disintegrating tools independent of the pump, it may, for example, be driven from the impeller of the pump either directly or through reduction gearing. The rotatable member of the disintegrating tools may be driven by means other than the electric motor sown, such as, a submerged hydraulic motor. Other modifications of the disclosed apparatus will be obvious to one knowledgable in the art to which the invention relates and it is the intention to hereby cover all modifications of the disclosed apparatus coming within the scope of the appended claims.

What is claimed is:

1. In a waste material handling system having a holding tank and a centrifugal pump means having an intake within the tank for pumping material from the tank, a solid material disintegrator and vortex circulation device comprising: a housing at the pump intake terminating in a bell-like flange, a nonrotatable shear plate in said housing adjacent to the base of said flange, said shear plate having a central through opening and a plurality of through openings located radially of the central opening and closing the base of said flange except for said openings, a power-driven shaft rotatable in and extending through said central opening in said shear plate, a multi-bladed knife member nonrotatably connected to said shaft and located within said flange at the side of said shear plate facing the opening of said flange, and a plurality of plate-like paddles connected to said knife member.

2. An apparatus as claimed in claim 1 in which the multi-bladed knife member is slidably keyed to the power driven shaft and spring biased into engagement with the shear plate.

3. An apparatus as claimed in claim 1 in which the leading sides of the blades of the knife member and the forward ends of the apertures in the shear plate radially of the central opening therethrough referring to the direction of rotation of the knife member terminate in linear cutting edges diverging from one another in the direction towards the central opening in the shear plate as the cutting edges of the knife member pass by the cutting edges on the shear plate during operation of the apparatus.

4. An apparatus as claimed in claim 1 in which the blades of the multi-bladed knife member and the through openings in the shear plate radially of the central opening therethrough are uniformly spaced about the longitudinal axis of the power driven shaft and the number of blades differ from the number of such through openings by one.

5. An apparatus as claimed in claim 1 in which the leading sides of the blades of the knife member and the forward ends of the apertures in the shear plate radially of the central opening therethrough referring to the direction of rotation of the knife member terminate in linear cutting edges diverging from one another in the direction towards the central opening in the shear plate at an angle which increases from about 10° to about 35° as the cutting edges of the knife member pass by the cutting edges on the shear plate during operation of the apparatus.

6. A solid material disintegrator and vortex circulating device comprising a housing member having one side formed for connection to the material inlet of a waste material handling centrifugal pump and an opening in another side surrounded by a bell-like flange, a nonrotatable shear plate in said housing member adjacent to the base of said flange, said shear plate having a central through opening and a plurality of through openings located radially of the central openings and closing the base of said flange except for said openings, a shaft rotatable in said central through opening in said shear plate, a multi-bladed knife member nonrotatably connected to said shaft and located within said flange at the side of said shear plate facing the opening of said flange, and a plurality of plate-like paddles connected to said knife member.

7. An apparatus as claimed in claim 6 in which the multi-bladed knife member is slidably keyed to the power driven shaft and spring biased into engagement with the shear plate.

8. An apparatus as claimed in claim 6 in which the leading sides of the blades of the knife member and the forward ends of the apertures in the shear plate radially of the central opening therethrough referring to the direction of rotation of the knife member terminate in linear cutting edges diverging from one another in the direction towards the central opening in the shear plate as the cutting edges of the knife member pass by the cutting edges on said shear plate during operation of the apparatus.

9. An apparatus as claimed in claim 6 in which the blades of the multi-bladed knife member and the through openings in the shear plate radially of the central opening therethrough are uniformly spaced about the longitudinal axis of the power driven shaft and the number of blades differ from the number of such through openings by one.

10. An apparatus as claimed in claim 6 in which the leading sides of the blades of the knife member and the forward ends of the apertures in the shear plate referring to the direction of rotation of the knife member terminate in linear cutting edges diverging from one another in the direction towards the central opening in the shear plate at an angle which increases from about 10° to about 35° as the cutting edges of the knife member pass by the cutting edges on the shear plate during operation of the apparatus.

* * * * *

UNITED STATES PATENT AND TRADEMARK OFFICE

CERTIFICATE OF CORRECTION

PATENT NO. : 4,145,008

DATED : March 20, 1979

INVENTOR(S) : Dale E. Wolford

It is certified that error appears in the above-identified patent and that said Letters Patent are hereby corrected as shown below:

Column 2, line 29, before "and" insert the following new paragraph:

-- FIG. 5 is a view as seen from the line 5-5 of FIG. 1; --

Column 2, line 28 "Fig.1" should read -- Fig. 2 --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*